US008517297B2

(12) United States Patent
Tada et al.

(10) Patent No.: US 8,517,297 B2
(45) Date of Patent: Aug. 27, 2013

(54) APPARATUS FOR FRACTURING POLYCRYSTALLINE SILICON AND METHOD FOR PRODUCING FRACTURED FRAGMENTS OF POLYCRYSTALLINE SILICON

(75) Inventors: Ryusuke Tada, Saitama (JP); Motoki Sato, Naka-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 13/282,551

(22) Filed: Oct. 27, 2011

(65) Prior Publication Data

US 2012/0119004 A1 May 17, 2012

(30) Foreign Application Priority Data

Oct. 28, 2010 (JP) ..... 2010-242062

(51) Int. Cl.
*B02C 23/00* (2006.01)
*B02C 13/09* (2006.01)
*B02C 13/20* (2006.01)

(52) U.S. Cl.
USPC ..... 241/295; 241/189.1; 241/235

(58) Field of Classification Search
USPC ..... 241/187, 189.1, 236, 235, 295, 191, 241/294
See application file for complete search history.

(56) References Cited

U.S. PATENT DOCUMENTS

| | | | | |
|---|---|---|---|---|
| 5,383,616 | A * | 1/1995 | Svaighert | 241/242 |
| 6,094,795 | A * | 8/2000 | Davenport | 29/407.1 |
| 6,953,166 | B2 * | 10/2005 | Schenk | 241/79 |
| 7,487,931 | B2 * | 2/2009 | Monyak | 241/197 |
| 7,584,921 | B1 * | 9/2009 | Bennington et al. | 241/294 |
| 2006/0070569 | A1 | 4/2006 | Andrejewski et al. | |
| 2006/0088970 | A1 | 4/2006 | Hesse et al. | |
| 2009/0114748 | A1 | 5/2009 | Gruebl et al. | |
| 2009/0206186 | A1 * | 8/2009 | Morrison et al. | 241/24.16 |

FOREIGN PATENT DOCUMENTS

| | | | |
|---|---|---|---|
| JP | 2006-122902 | A | 5/2006 |
| JP | 2006-192423 | A | 7/2006 |
| JP | 2009-531172 | A | 9/2009 |

* cited by examiner

*Primary Examiner* — Faye Francis
(74) *Attorney, Agent, or Firm* — Edwards Wildman Palmer LLP

(57) ABSTRACT

An apparatus for fracturing polycrystalline silicon having: a pair of rolls which are rotated in a counter direction each other around parallel axes; a plurality of fracturing teeth which are provided on and protruded radially-outwardly from outer peripheral surfaces of the rolls, and are made from cemented carbide or silicon material; and resin covers being wound around the roll in a state in which the fracturing teeth penetrate thereof so as to cover the outer peripheral surfaces of the rolls, and fractures fragments of polycrystalline silicon between the rolls.

2 Claims, 4 Drawing Sheets

APPARATUS FOR FRACTURING POLYCRYSTALLINE SILICON AND METHOD FOR PRODUCING FRACTURED FRAGMENTS OF POLYCRYSTALLINE SILICON

CROSS REFERENCE TO RELATED APPLICATIONS

This application is related to four co-pending applications, all of them entitled, "APPARATUS FOR FRACTURING POLYCRYSTALLINE SILICON AND METHOD FOR PRODUCING FRACTURED FRAGMENTS OF POLYCRYSTALLINE SILICON" filed concurrently herewith as follows: in the names of Ryusuke Tada and Motoki Sato which claims priority to Japanese Patent Application No. 2010-242063 filed Oct. 28, 2010; in the names of Ryusuke Tada, Takahiro Matsuzaki, Shunsuke Kotaki and Motoki Sato which claims priority to Japanese Patent Application No. 2010-242061 filed Oct. 28, 2010; in the names of Takahiro Matsuzaki and Shunsuke Kotaki which claims priority to Japanese Patent Application No. 2010-242060 filed Oct. 28, 2010; and in the names of Takahiro Matsuzaki, Teruyoshi Komura, Shunsuke Kotaki and Motoki Sato which claims priority to Japanese Patent Application No. 2010-242059 filed Oct. 28, 2010, which co-pending applications are assigned to the assignee of the instant application and which co-pending applications are also incorporated by reference herein.

BACKGROUND OF THE INVENTION

1. Field of the Invention

The present invention relates to an apparatus for fracturing polycrystalline silicon which is raw material of semiconductor silicon or the like into fragments, and a method for producing fractured fragments of polycrystalline silicon using the apparatus for fracturing.

Priority is claimed on Japanese Patent Application No. 2010-242062, filed Oct. 28, 2010, the content of which is incorporated herein by reference.

2. Description of Related Art

A silicon wafer which is used for a semiconductor chip is manufactured from single-crystal silicon which is produced by, for example, Czochralski method ("CZ method"). For producing single-crystal silicon by the CZ method, for example, fractured fragments of polycrystalline silicon that is obtained by fracturing rod-shaped polycrystalline silicon formed by Siemens process is used.

For fracturing polycrystalline silicon, as shown in FIG. 8, a rod R of polycrystalline silicon is fractured to fragments C of a few millimeters to a few centimeters. In this process, it is typical to break the rod R into appropriate size by thermal shock or the like, and then further hit and break the fragments with a hammer directly. However, the process strains workers, so that it is inefficient to obtain fragments of appropriate size from rod-shaped polycrystalline silicon.

In Japanese Unexamined Patent Application, First Publication No. 2006-122902, a method for obtain silicon fragments by fracturing rod-shaped polycrystalline silicon with a roll-crasher is disclosed. The roll-crasher is a single-roll crasher in which one roll is stored in a housing and a plurality of teeth are formed on a surface of the roll. The roll-crasher fractures the rod-shaped polycrystalline silicon by collapsing between the teeth and an inner surface of the housing so as to impact the polycrystalline silicon continuously.

On the other hand, in Published Japanese Translation No. 2009-531172 of the PCT International Publication and Japanese Unexamined Patent Application, First Publication No. 2006-192423, apparatuses for fracturing roughly-crashed fragments of polycrystalline silicon are proposed. These apparatuses are double-roll crashers having two rolls and crashing the roughly-crashed fragments of polycrystalline silicon between the rolls.

Polycrystalline silicon can be efficiently fractured by those fracturing apparatus. However, since polycrystalline silicon is hard, there is a case in which the fracturing teeth and the outer surfaces of the rolls may be chipped or worn, so that the impurities may be entered into the fractured fragments of polycrystalline silicon and may cause contaminate.

SUMMARY OF THE INVENTION

Problems to be Solved by the Invention

The present invention is contrived in view of the circumstances, and an object of the present invention is to provide an apparatus which fractures polycrystalline silicon into desired size by fracturing teeth provided on rolls and in which contamination of the fractured fragment of polycrystalline silicon by impurities generated from the fracturing teeth and an outer surface of the rolls, so that high-quality polycrystalline silicon can be obtained, and to provide a method for producing the fractured fragments of polycrystalline silicon using the apparatus for fracturing.

Means for Solving the Problem

An apparatus for fracturing polycrystalline silicon according to the present invention has: a pair of rolls which are rotated in a counter direction each other around parallel axes; a plurality of fracturing teeth which are provided on and protruded radially-outwardly from outer peripheral surfaces of the rolls, and are made from cemented carbide or silicon material; and resin covers being wound around the roll in a state in which the fracturing teeth penetrate thereof so as to cover the outer peripheral surfaces of the rolls, and fractures fragments of polycrystalline silicon between the rolls.

By forming the fracturing teeth from cemented carbide or silicon material, impurities are prevented from contaminating polycrystalline silicon. Furthermore, by providing the resin covers which cover the outer peripheral surfaces of the rolls, impurities are prevented from being generated even though the fragments of polycrystalline silicon are in contact with the outer peripheral surfaces of the rolls. Therefore, the fractured fragments of polycrystalline silicon can be prevented from being contaminated by impurities, so that high-quality polycrystalline silicon can be obtained.

Moreover, although the resin covers are worn, the apparatus for fracturing can be used for a long term by replacing the resin covers.

In the apparatus for fracturing polycrystalline silicon according to the present invention, the apparatus preferably further has a pair of partition plates with a certain interval which are provided at both ends of the rolls so as to span the rolls and cross the axes of the rolls, and at least a surface is preferably formed from resin in the partition plate.

In this case, since polycrystalline silicon is fractured in a limited space which is comparted by the pair of rolls and the pair of the partition plates, polycrystalline silicon is prevented from being in contact with the other part of the apparatus, so that the fragments of polycrystalline silicon can be reliably prevented from being contaminated by impurity.

In the apparatus for fracturing polycrystalline silicon according to the present invention, it is preferable that a top surface of the fracturing tooth be formed spherically; and a side surface of the fracturing tooth be formed cylindrically.

The top surfaces of the fracturing teeth are formed spherically, so that the top surfaces of the fracturing teeth and polycrystalline silicon are in contact at points. The side surfaces of the fracturing teeth are formed cylindrically, so that the side surfaces of the fracturing teeth and polycrystalline silicon are in contact in lines. Therefore, since the fracturing teeth and polycrystalline silicon are in contact at points or in lines, polycrystalline silicon can be prevented from being ground into powder by the fracturing teeth and a loss rate can be reduced.

A method for producing fractured fragments of polycrystalline silicon according to the present invention products the fractured fragments of polycrystalline silicon by using the apparatus for fracturing polycrystalline silicon described above.

Effects of the Invention

According to the present invention, polycrystalline silicon can be fractured continuously and efficiently by rotating the rolls. Also, the fractured fragments of polycrystalline silicon can be prevented from being contaminated by impurities from the fracturing teeth and the outer peripheral surface of the roll. Therefore, high-quality polycrystalline silicon can be obtained.

DESCRIPTION OF THE PREFERRED EMBODIMENTS

Hereinafter, an embodiment of an apparatus for fracturing polycrystalline silicon according to the present invention and a method for producing fractured fragments of polycrystalline silicon using the apparatus will be described with reference to the drawings.

Figure 1:
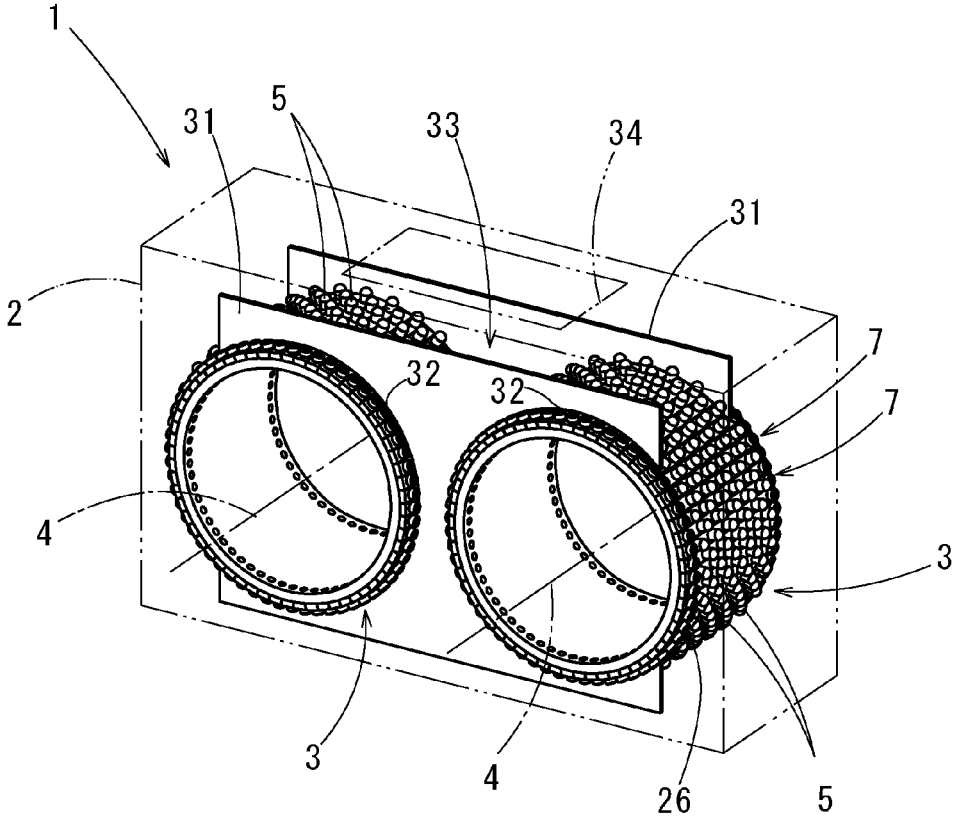
FIG. 1 is a partial perspective view showing an embodiment of an apparatus for fracturing polycrystalline silicon according to the present invention.
Figure 2:
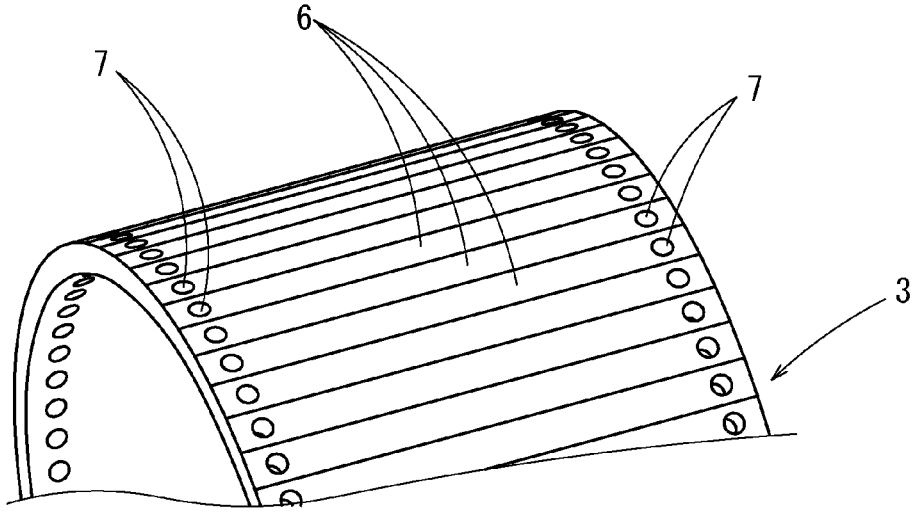
FIG. 2 is a perspective view showing a surface of roll of the apparatus for fracturing shown in FIG. 1.

As shown in FIG. 1, an apparatus 1 for fracturing (hereinafter, "the fracturing apparatus 1") of the present embodiment is provided with two rolls 3 which are arranged in a housing 2 so that axes 4 of the rolls 3 are horizontal and parallel with each other. A plurality of fracturing teeth 5 are provided on an outer peripheral surface of both the rolls 3 so as to protruding radially-outwardly. As shown in FIG. 2, the outer peripheral surfaces of the rolls 3 are not even arc surfaces, but are formed as a polyhedral shape configured from long planes 6 which are elongated along the axis direction and are connected along a circumferential direction. Threaded holes 7 are formed at both ends of the planes 6. On each of the planes 6, a fracturing teeth unit 8 is fixed.

Figure 3:
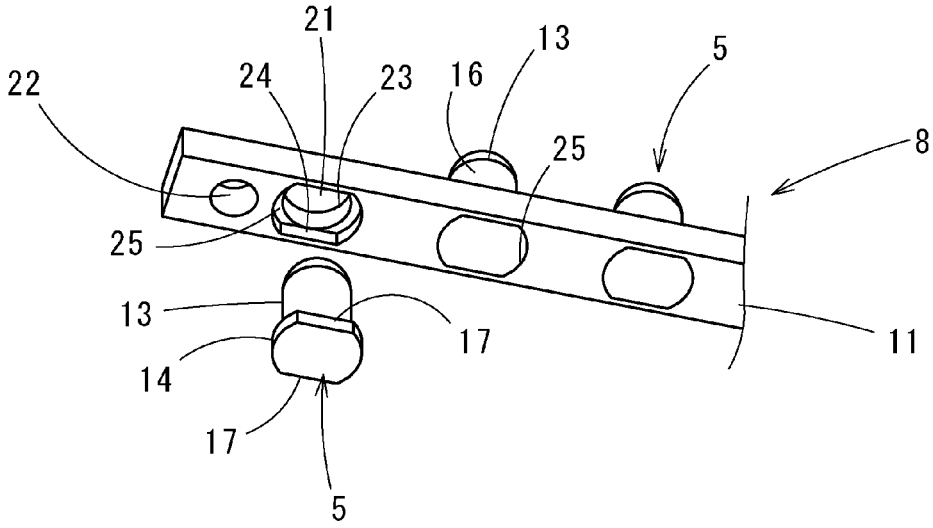
FIG. 3 is a perspective rear view showing a fracturing teeth unit installed in the apparatus for fracturing in FIG. 1.
Figure 4:
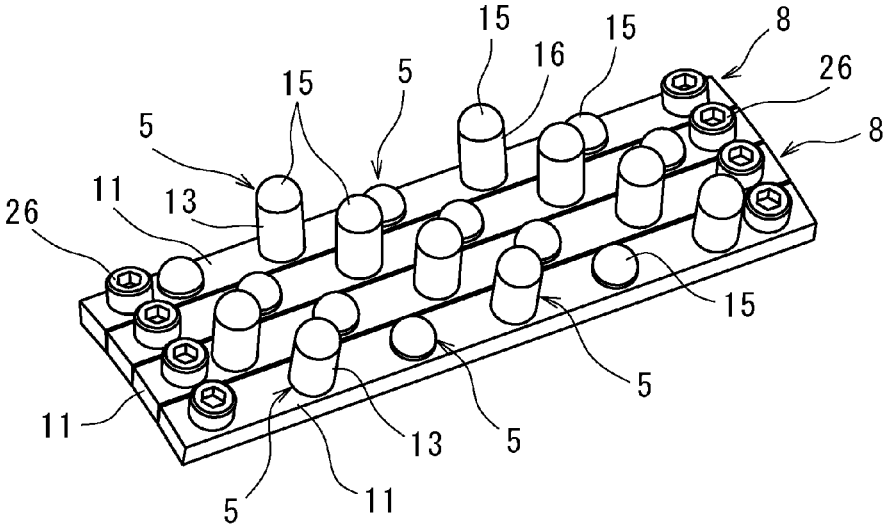
FIG. 4 is a perspective view showing a row of the plurality of the fracturing teeth units.

The fracturing teeth unit 8 is provided with a fixing cover 11 which is in contact with the plane 6 of the roll 3, and the plurality of fracturing teeth 5 which are fixed to the fixing cover 11 as shown in FIG. 3 and FIG. 4.

Figure 5:
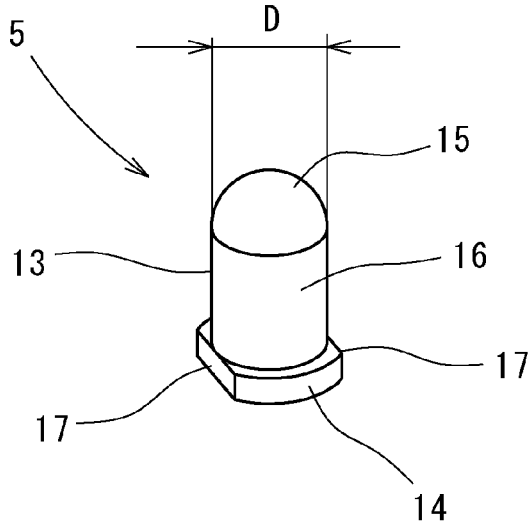
FIG. 5 is a perspective view showing the fracturing tooth.

The fracturing tooth 5 is formed as a unit from cemented carbide or silicon material, and has a column part 13 and a flange 14 which expands in diameter at a base part of the column part 13 as shown in FIG. 5. A top surface 15 of the column part 13 is formed spherically; and a side surface 16 of the column part 13 is formed cylindrically. The flange 14 is formed so that both sides of a circular plate are cut parallel to a longitudinal direction of the column part 13 (i.e., a longitudinal direction of the fracturing tooth 5), so that flat parts 17 are formed in 180° opposite direction from each other.

The fixing cover 11 is formed as a strip having a same width and a same length as that of the plane 6 of the roll 3. Fixing holes 21 for fracturing teeth are formed with intervals along a longitudinal direction of the fixing cover 11 so as to penetrate the fixing cover 11. Through-holes 22 for screw are formed at both sides of the fixing cover 11. As shown in FIG. 3, each of the fixing holes 21 is configured with a fit hole 23 and an expanded part 25. The fit hole 23 is formed to a half depth of thickness of the fixing cover 11, and has a circular cross-section corresponding with the side surface 16 of the column part 13 of the fracturing tooth 5. The other half depth of the thickness of the fixing cover 11 of the fixing hole 21 is the expanded part 25 having flat parts 24 corresponding to the flange 14 of the fracturing tooth 5. The fracturing tooth 5 is fixed to the fixing cover 11 so as not to rotate by fitting into the expanded part 25 in a state in which the column part 13 is fitted into the fit hole 23 of the fixing cover 11 and by the flat parts 24 of the fixing cover 11 being in contact with the flat parts 17 of the flange 14.

The fixing cover 11 is laid on each of the planes 6 of the rolls 3 in a state in which the expanded parts 25 face to the surfaces of the rolls 3 and the column parts 13 of the fracturing teeth 5 are protruded from the fit holes 23, and both ends of the fixing cover 11 are fixed to the surfaces of the rolls 3 by screws 26.

Figure 8:
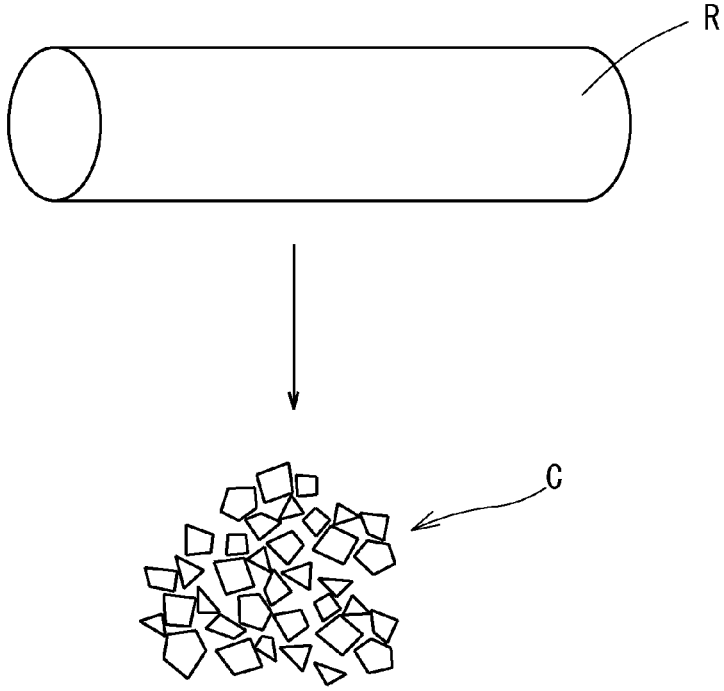
FIG. 8 is a schematic view showing fragments obtained by fracturing a rod of polycrystalline silicon.

The fracturing teeth units 8 are arranged so that the fracturing teeth 5 of the adjacent fracturing units 8 are not rowed along the circumferential direction of the rolls 3, as shown in FIGS. 4 and 8. That is, the adjacent fracturing teeth units 8 are installed on the rolls 3 so that the fracturing teeth 5 are arranged in a staggered manner.

Figure 6:
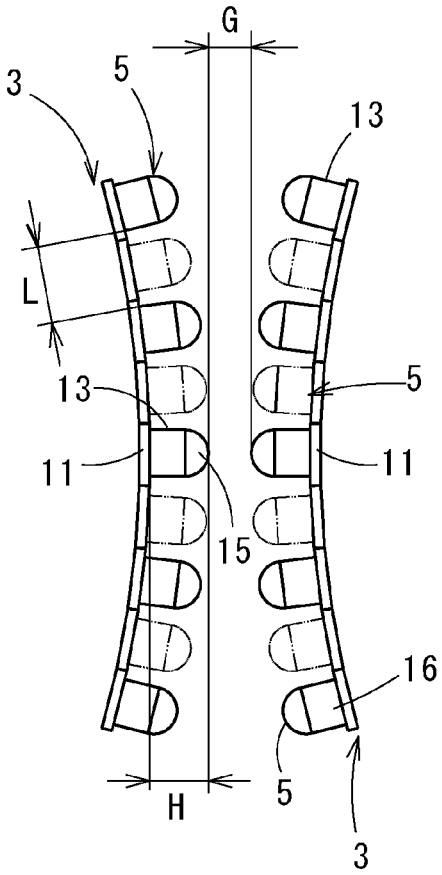
FIG. 6 is a front view showing a positional relation of the rolls at a facing part.

On the other hand, between the rolls 3, the fracturing teeth 5 are arranged so the top surfaces 15 of the fracturing teeth 5 on the rolls 3 face each other at the facing part ((i.e., at a position in which the fracturing teeth 5 of each rolls 3 are closest each other) as shown in FIG. 6.

In FIG. 6, among the staggered fracturing teeth 5, the fracturing teeth 5 arranged in a same circumferential row are denoted by continuous lines; and the fracturing teeth 5 arranged in the other circumferential row are denoted by two-dot lines.

In this embodiment, target size of fragments of polycrystalline silicon after fracturing (i.e., fractured fragments of polycrystalline silicon) is set in a range of 5 mm to 60 mm in maximum length. In order to obtain the fragments of such size: a diameter D of the column part 13 of the fracturing tooth 5 is set in a range of 10 mm to 14 mm; a protruding height H of the fracturing tooth 5 from the surface of the fixing cover 11 to the tip of the fracturing tooth 5 shown in FIG. 6 is set in a range of 20 mm to 30 mm; and a distance L between the adjacent fracturing teeth 5 is set in a range of 11 mm to 35 mm. At the facing part of the rolls 3, a facing distance G between the top surfaces 15 of the fracturing teeth 5 is set in a range of 5 mm to 30 mm.

Figure 7:
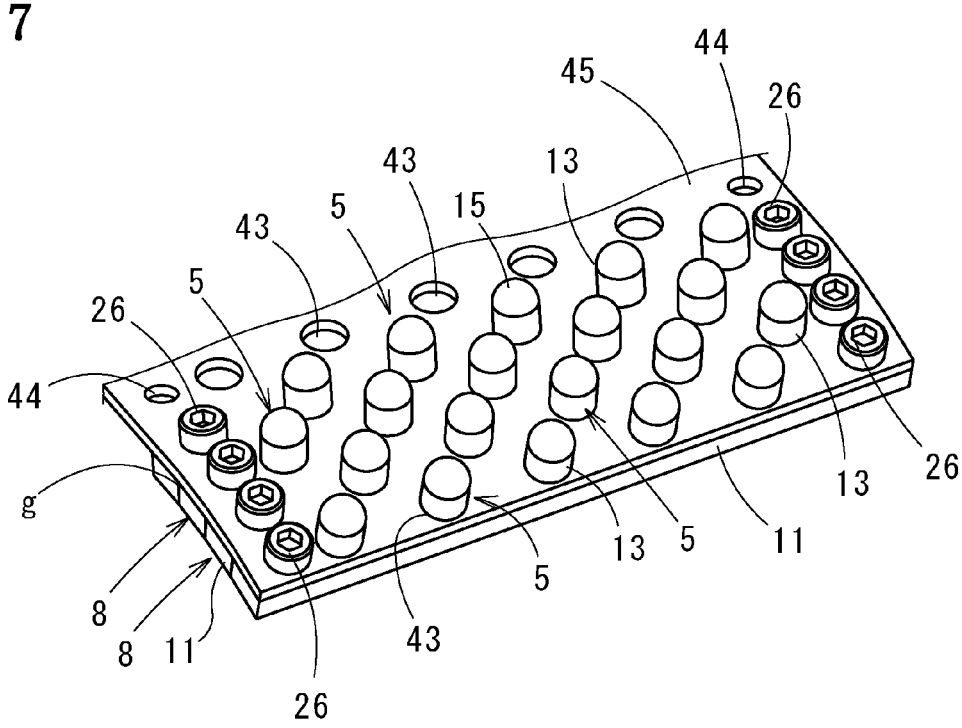
FIG. 7 is a perspective view showing a substantial part of the fracturing teeth units in a state in which the units are coated with a resin cover.

As shown in FIG. 7, on the surfaces of the fixing covers 11 which are arranged to form the outer peripheral surface of the roll 3, a resin cover 45 made from polypropylene or the like is provided on the fixing covers 11 so as to cover the outer peripheral surface of the roll 3. The resin cover 45 has a plurality of holes 43 and 44 through which the fracturing teeth 5 and the screws 26 penetrate. The resin cover 45 is formed as a sheet which can cover the outer peripheral surface of the roll 3, wound around the roll 3 in a state in which the column parts 13 of the fracturing teeth 5 penetrate the holes 43, and is fixed on the surface of the roll 3 with the fixing covers 11 by the screws 26.

The housing 2 in which the rolls 3 are set is formed of resin such as polypropylene or the like, or formed of metal having an inner coating of tetrafluoroethylene in order to prevent contamination.

In the housing 2, a pair of partition plates 31 which cross the axes 4 of the rolls 3 are provided at both ends of the rolls 3 with a certain interval with respect to the inner wall surface of the housing 2 so as to be parallel with the inner wall surface of the housing 2. The partition plates 31 are fixed to the housing 2, have two cutouts 32 which are formed by being cut at circular arc shape with slightly larger diameter than that of the rolls 3 so as to engage the half or more of the rolls 3, and are arranged with spanning the rolls 3 in a state in which the cutouts 32 are engaged to the ends of the rolls 3.

In a state in which the partition plates 31 are engaged to the rolls 3, gaps are formed between inner peripheral surfaces of the cutouts 32 of the partition plates 31 and outer peripheral surfaces of the rolls 3 so as not to disturb the rotation of the rolls 3. Also, the screws 26 for fixing the fracturing teeth units 8 which are provided at both the ends of the rolls 3 are positioned outside the partition plates 31 so that spaces above and below the facing part of the rolls 3 are located between the partition plates 31. The space between the partition plates 31 is a fracturing space 33 for polycrystalline silicon. On an upper surface of the housing 2, an inlet 34 is formed so as to be arranged immediately above the fracturing space 33. The partition plates 31 are formed from resin such as polypropylene or the like or metal having inner coating of tetrafluoroethylene, as the housing 2.

The housing 2 is provided with a gearbox or the like (not shown) for rotary-driving the rolls 3. The gearbox is connected to an exhaust system (not shown) so as to exhaust the housing 2 and an inner space of the gearbox.

When fractured fragments of polycrystalline silicon is produced by using the fracturing apparatus 1 configured as described above, in a state of rolling the rolls 3, by supplying roughly-fractured polycrystalline silicon of appropriate size into the fracturing space 33 for polycrystalline silicon between the partition plates 31 through the inlet 34 of the housing 2, the fragments of polycrystalline silicon are further fractured into fragments between the fracturing teeth 5 of the rolls 3.

In the fracturing teeth 5, the top surfaces 15 are formed spherically, so that the top surfaces 15 and polycrystalline silicon are in contact at points. Also, in the fracturing teeth 5, the side surfaces 16 of the column parts 13 are formed cylindrically, so that the side surfaces 16 and polycrystalline silicon are in contact at points or in lines. Therefore, the fracturing teeth 5 impact polycrystalline silicon in a state of being in contact with polycrystalline silicon at points or in lines, so that polycrystalline silicon can be prevented from being crushed by planes.

The partition plates 31 which are arranged above the ends of the rolls 3 prevent the fragments of polycrystalline silicon which are fractured therebetween from being ground by entering between the inner wall surfaces of the housing 2 and the end surfaces of the rolls 3. Therefore, the fragments of polycrystalline silicon can be reliably fractured and pass through between the rolls 3.

As a result, in the fracturing apparatus 1, polycrystalline silicon can be fractured to of desired size, so that the powder can be prevented from being generated and the loss rate can be reduced.

Furthermore, in the fracturing apparatus 1, since the fracturing teeth 5 are formed from cemented carbide or silicon material, impurities are prevented from contaminating polycrystalline silicon from the fracturing teeth 5.

Furthermore, since the outer peripheral surface of the roll 3 is covered by the resin cover 45, the outer peripheral surface of the roll 3 is not worn even though polycrystalline silicon is in contact with the outer peripheral surface of the roll 3, so that impurities are prevented from being generated. Moreover, since the resin cover 45 covers gaps "g" between the fixing covers 11 of the fracturing teeth units 8 (see FIG. 7), fractured powder is prevented from being adhered to the gaps "g". If the resin cover 45 is worn, since the resin cover 45 can be replaced easily, the fracturing apparatus can be used for a long term.

Although the screws 26 which fix the fracturing teeth units 8 are generally made of metal, the screws 26 are not in contact with polycrystalline silicon since the screws 26 are arranged outside the fracturing space 33 for polycrystalline silicon. Furthermore, the partition plates 31 and the housing 2 surrounding the fracturing space 33 for polycrystalline silicon are made from resin such as polypropylene or the like, or are coated by tetrafluoroethylene. Therefore, polycrystalline silicon can be prevented from being contaminated by impurities while fracturing.

As a result, according to the fracturing apparatus 1, the fractured fragments of polycrystalline silicon can be prevented from being contaminated by impurities, so that high-quality polycrystalline silicon can be obtained.

Furthermore, in the present embodiment, the fracturing teeth units 8 in which the fixing cover 11 holds the fracturing teeth 5 independently with each other are fixed on the surface of the rolls 3. Therefore, when some fracturing teeth 5 are fallen or chip away, it is sufficient to replace the defective fracturing teeth 5. In this case, since the fracturing teeth units 8 are fixed to the rolls 3 by the screws 26 and the fracturing teeth 5 are only fitted into the fixing holes 21 for fracturing teeth of the fixing cover 11, it is easy to replace some of the fracturing teeth 5.

The present invention is not limited to the above-described embodiments and various modifications may be made without departing from the scope of the present invention.

For example, the side surfaces of the column parts of the fracturing teeth are formed cylindrically in the above embodiments. However, the side surfaces may be formed conically. Furthermore, the tips of the fracturing teeth may be formed conically so as to be connected with the spherical top surfaces and a cylindrical base part.

Also, dimensions of the facing gaps or the like of the fracturing teeth are not limited to the above-described embodiments.

What is claimed is:

1. An apparatus for fracturing polycrystalline silicon comprising:

a pair of rolls which are rotated in a counter direction each other around parallel axes;

a plurality of fracturing teeth which are provided on and protruded radially-outwardly from outer peripheral surfaces of the rolls, and are made from cemented carbide or silicon material;

resin covers being wound around the roll in a state in which the fracturing teeth penetrate the resin covers so as to cover the outer peripheral surfaces of the rolls; and a pair of partition plates with a certain interval which are provided at both ends of the rolls so as to span the rolls and cross the axes of the rolls, wherein at least a surface is formed from resin in the partition plate, and fractures fragments of polycrystalline silicon between the rolls.

2. The apparatus for fracturing polycrystalline silicon according to claim 1, wherein:

a top surface of the fracturing tooth is formed semi-spherically; and a side surface of the fracturing tooth is formed cylindrically.

* * * * *